US005809696A

United States Patent [19]

Watanabe

[11] Patent Number: 5,809,696

[45] Date of Patent: Sep. 22, 1998

[54] PACKING MOUNTING STRUCTURE FOR VEHICLE DOOR POWERED SLIDING DEVICE

[75] Inventor: Mitsuhiro Watanabe, Yamanashi-ken, Japan

[73] Assignee: Misui Kinzoku Kogyo Kabushiki Kaisha, Tokyo, Japan

[21] Appl. No.: 825,932

[22] Filed: Apr. 1, 1997

[30] Foreign Application Priority Data

Apr. 2, 1996 [JP] Japan ..... 8-104519

[51] Int. Cl.[6] ..... E05F 11/36; E05F 11/53

[52] U.S. Cl. ..... 49/360; 49/352; 49/213

[58] Field of Search ..... 49/360, 361, 213, 49/214, 352, 280; 296/155, 146.11, 146.12, 152

[56] References Cited

U.S. PATENT DOCUMENTS

| | | | |
|---|---|---|---|
| 4,617,757 | 10/1986 | Kagiyama et al. | 49/213 |
| 4,640,050 | 2/1987 | Yamagishi et al. | 49/360 |
| 4,932,715 | 6/1990 | Kramer | 49/360 |
| 4,956,939 | 9/1990 | Kuhlman | 49/280 |
| 5,025,591 | 6/1991 | DeLand | 49/280 |
| 5,063,710 | 11/1991 | Schap | 49/280 |
| 5,069,000 | 12/1991 | Zuckerman | 49/214 |
| 5,155,937 | 10/1992 | Yamagishi et al. | 49/280 |
| 5,644,869 | 7/1997 | Buchanan, Jr. | 49/280 |
| 5,716,044 | 2/1998 | Peterson | 296/152 |
| 5,746,025 | 5/1998 | Shimura | 49/360 |

FOREIGN PATENT DOCUMENTS 0598427 5/1994 European Pat. Off. .

*Primary Examiner*—Daniel P. Stodola
*Assistant Examiner*—Curtis Cohen
*Attorney, Agent, or Firm*—Browdy and Neimark

[57] ABSTRACT

A packing mounting structure for a vehicle door powered sliding device comprises an elongated guide rail fixed to a side panel of a vehicle body, a sliding door mounted on the body, a powered sliding unit arranged on an interior side of the side panel, a wire cable provided between the sliding door and the powered sliding unit, a pulley holder provided in the vicinity of one end of the guide rail and having a first pulley around which the cable wire is set, a cable hole formed on the side panel in the vicinity of the one end of the guide rail for passing the wire cable through the side panel, a flexible packing member mounted in the cable hole to close a gap between the cable hole and the wire cable. The pulley holder is fixed to the side panel by either of a screw or bolt. The packing member has an inserting portion which is inserted into the cable hole, and a large-diameter portion which has a diameter sufficiently larger than that of the cable hole and abuts on an inside surface of the side panel when the inserting portion is inserted into the cable hole. The large-diameter portion is firmly sandwiched between the pulley holder and the side panel.

7 Claims, 5 Drawing Sheets

10
9
10
23
6
39
31
40
38
18
35
19
36
22
37
21
16
15
17

PACKING MOUNTING STRUCTURE FOR VEHICLE DOOR POWERED SLIDING DEVICE

FIELD OF THE INVENTION

The present invention relates to a packing mounting structure for a vehicle door powered sliding device and, more particularly, to a mounting structure for mounting a packing installed in a cable hole through which a wire cable for a powered sliding device passes.

DESCRIPTION OF RELATED ARTS

A well-known vehicle sliding door moves substantially in parallel with a rear side panel (quarter panel) of a vehicle body between the open position and the closed position thereof. The sliding door has rollers engaging with a longitudinally long guide rail which is fixed to the side panel. To move the sliding door forward or rearward, a relatively strong force is required. Therefore, some sliding doors have a powered sliding device for moving the door forward or rearward by the power of motor.

Generally, the prior art powered sliding device is connected to the sliding door via a wire cable. A half of the wire cable is arranged in the guide rail, and the remaining half thereof is arranged on the interior side of the side panel. In the vicinity of the front end of the guide rail is installed a front pulley over which the cable passes, and in the vicinity of the rear end of the guide rail is installed a rear pulley over which the cable passes. In the vicinity of the front pulley and the rear pulley, on the side panel are formed front and rear cable holes, respectively, through which the wire cable passes.

To prevent rainwater, car wash water and dust from entering the interior side of vehicle body through the cable hole, a flexible packing is mounted in the cable hole. However, the prior art simply constructed packing has a problem of being removed easily by external force.

SUMMARY OF THE INVENTION

Accordingly, an object of the present invention is to provide a packing mounting structure in which a packing is fixed to a side panel by taking advantage of a pulley holder to which a pulley is mounted to prevent the packing from being removed.

BRIEF DESCRIPTION OF THE DRAWINGS

The above and other objects, features and advantages of the present invention will become apparent from the detailed description of the preferred embodiments found below with reference to the accompanying drawings in which.

DETAILED DESCRIPTION OF THE PREFERRED EMBODIMENTS

Figure 1:
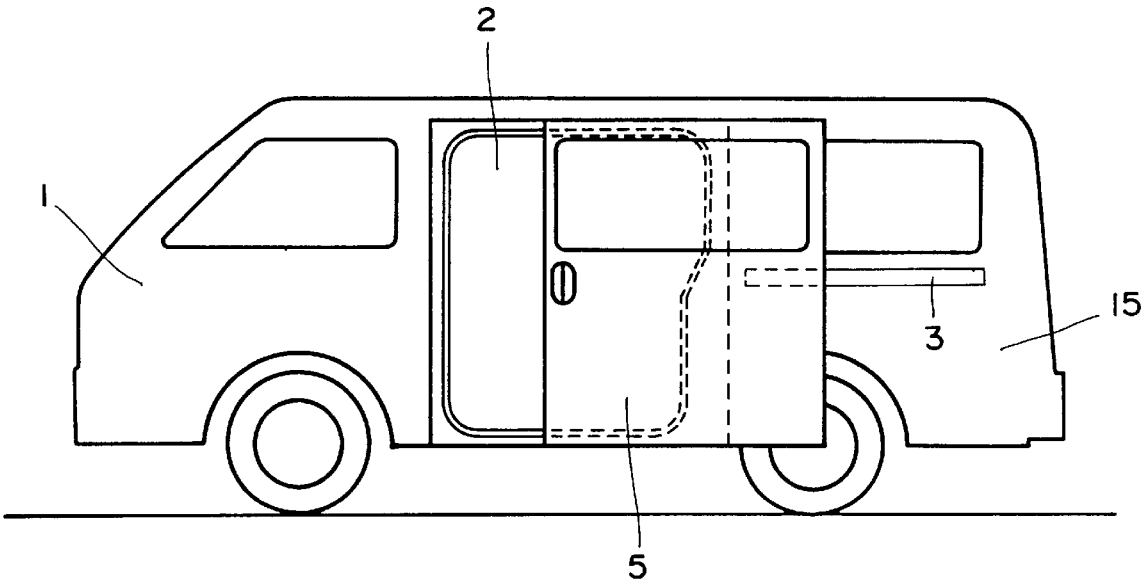
FIG. 1 is a side view showing a vehicle body and a sliding door.
Figure 2:
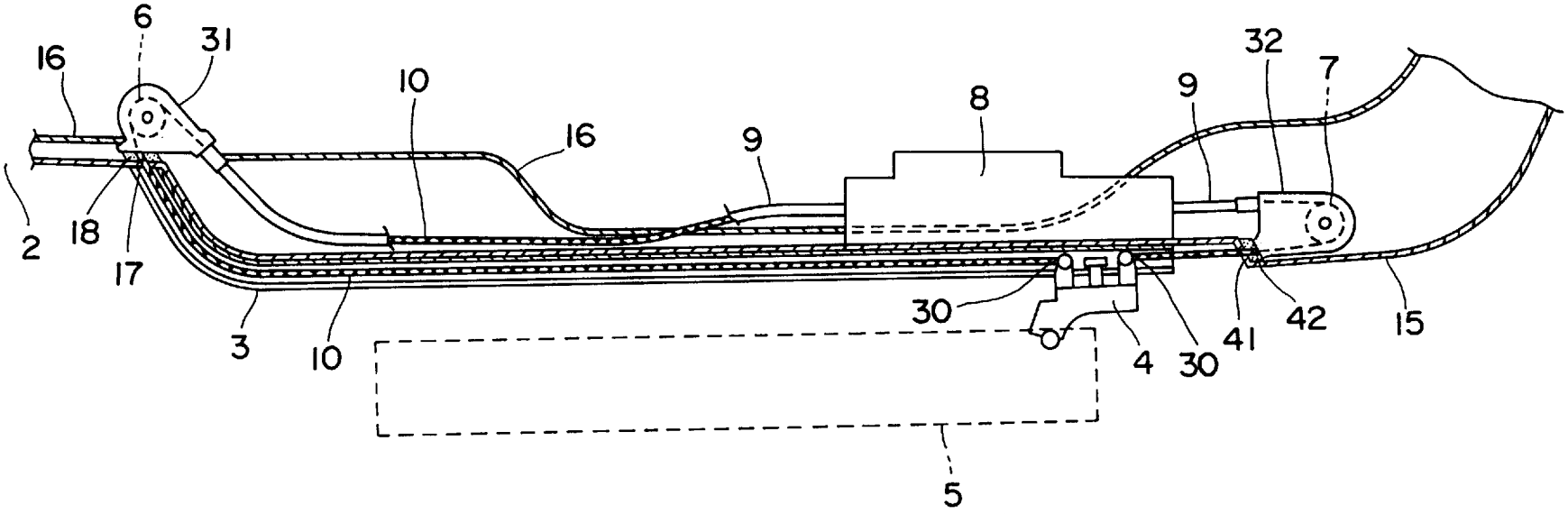
FIG. 2 is a sectional view showing the arrangement of a wire cable.

One embodiment of the present invention will be described with reference to the accompanying drawings. As shown in FIGS. 1 and 2, a rear side portion of a vehicle body 1 has a rear outer side panel or quarter panel 15, a rear inner side panel 16 corresponding to the outer panel 15, and a guide rail 3 fixed to an outer surface of the side panel 15. A sliding door 5 has a roller bracket 4 which is slidably engaged with the guide rail so that the sliding door can slide between an open position as shown by imaginary line and a closed position closing an entrance 2 of the vehicle body 1. A powered sliding unit 8 for sliding the sliding door 5 is installed on the interior side of the rear outer panel 15.

The powered sliding unit 8 is provided with a wire cable 10, a half of which is positioned on the interior side of the rear side panel 15, and the other half of which is positioned in the guide rail 3. End portions 30 and 30 of the cable 10 are connected to the roller bracket. In the vicinity of the front end of the guide rail 3, a front pulley holder 31 having a front pulley 6 for the cable 10 is provided, and in the vicinity of the rear end of the guide rail 3, a rear pulley holder 32 having a rear pulley 7 for the cable 10 is provided. The cables 10 between the front holder 31 and the sliding unit 8 and between the rear holder 32 and the sliding unit 8 are covered with cable sheaths 9. However, the cable 10 in the guide rail 3 is not covered with a sheath.

Figure 3:
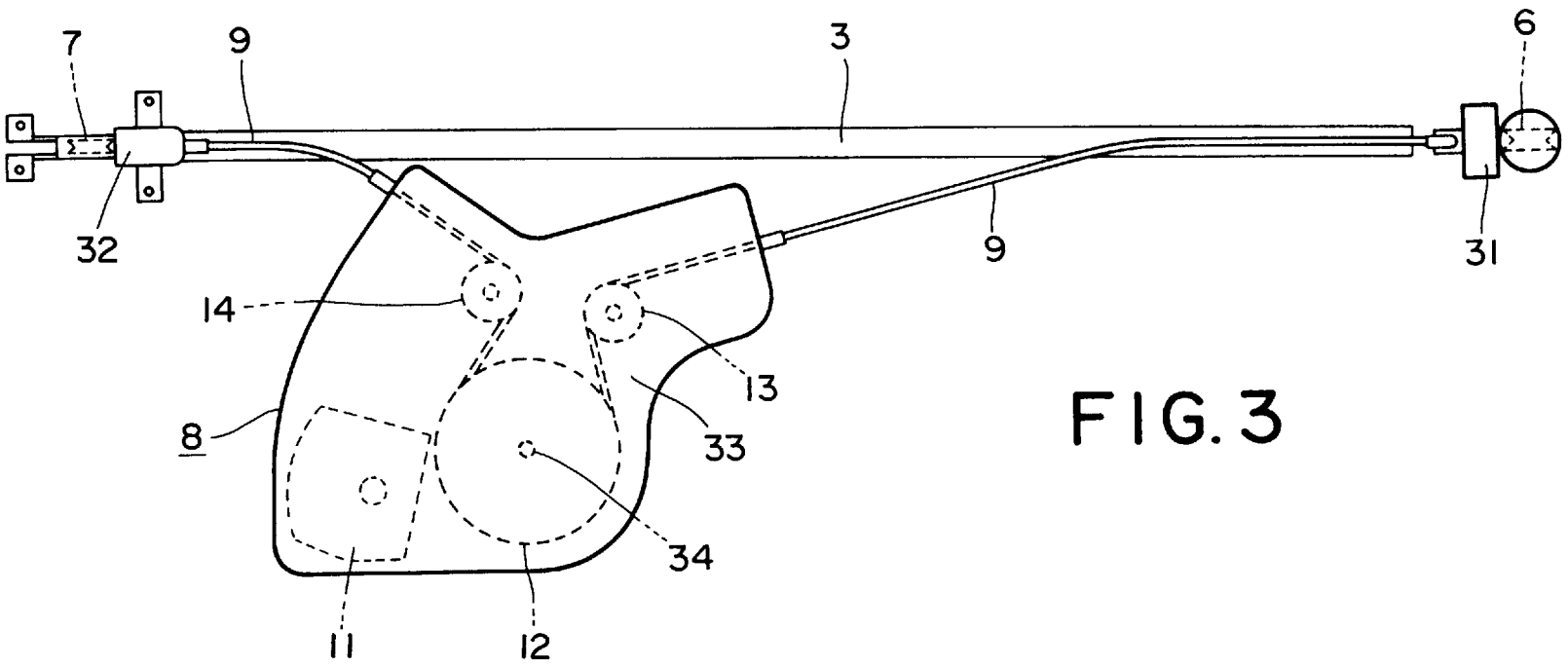
FIG. 3 is a side view showing a powered sliding unit, a wire cable, and front and rear pulleys.

As shown in FIG. 3, the powered sliding unit 8 has a base plate 33, an electric reversible motor 11 having a speed reduction mechanism fixed to the base plate 33, a wire drum 12 rotated by the motor 11, and tension pulleys 13 and 14. The wire drum 12 is supported on the base plate 33 by means of a drum shaft 34. The cable 10 is wound around the wire drum 12. When the wire drum 12 is rotated in either direction by the rotation of the motor 11, the cable 10 is pulled forward or rearward so that the sliding door 5 slides toward the closed position or the open position.

Figure 4:
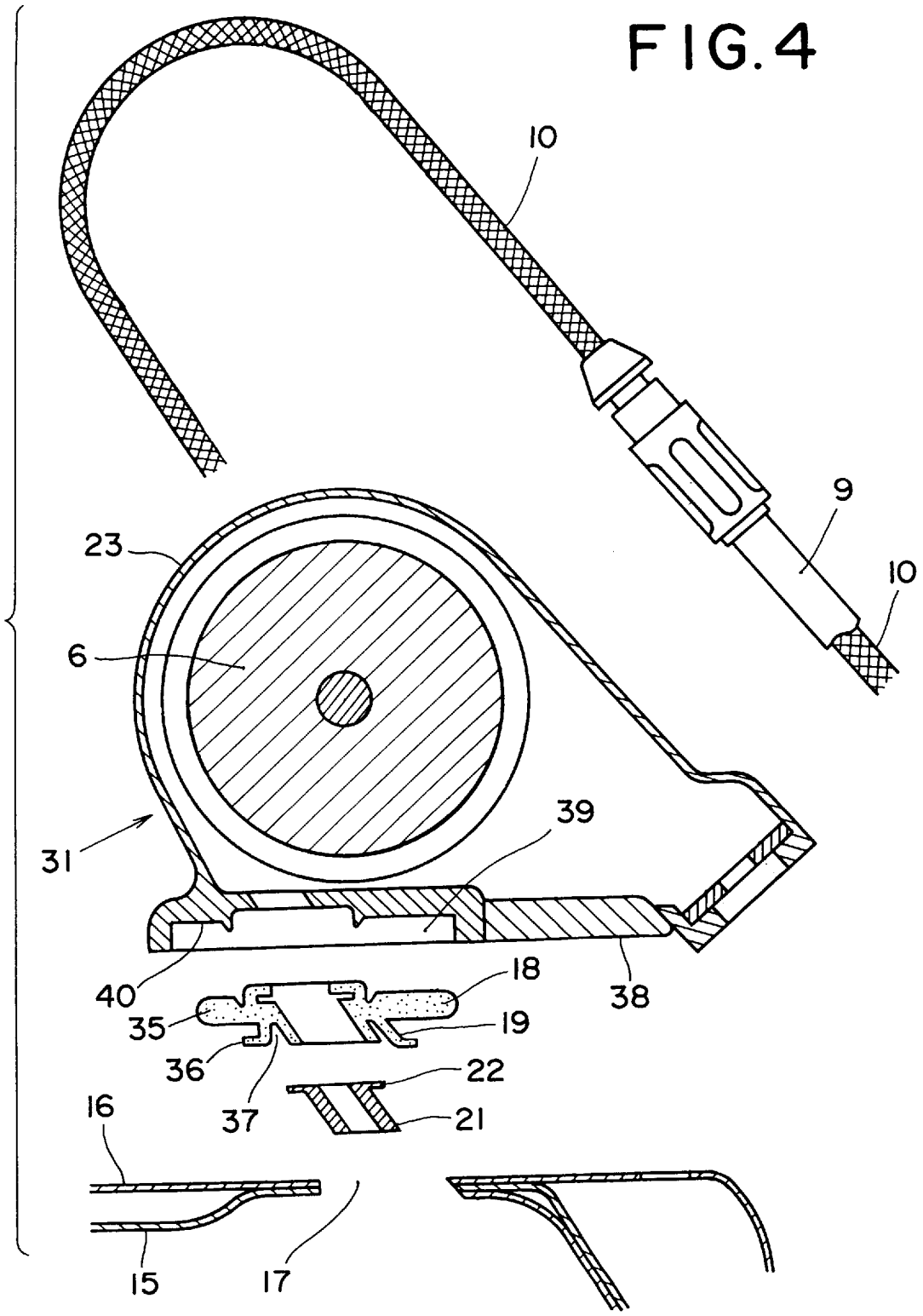
FIG. 4 is an exploded view of a front pulley holder.
Figure 5:
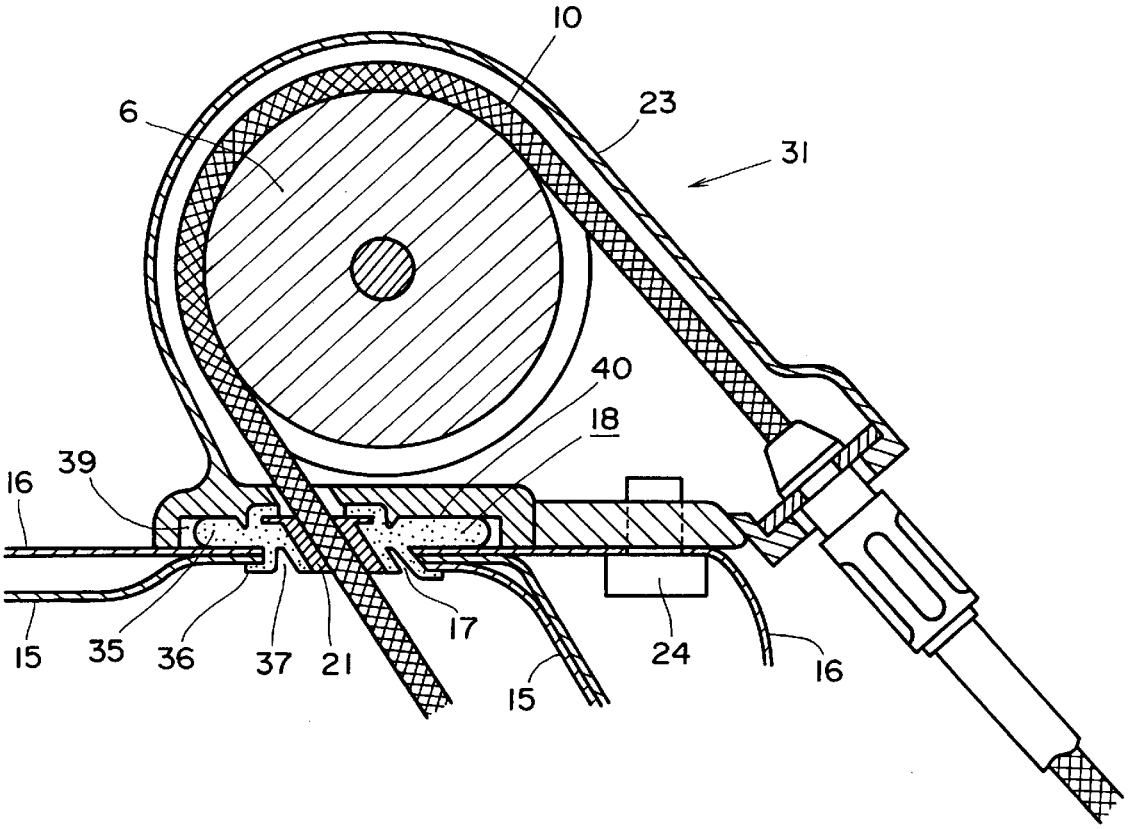
FIG. 5 is a sectional view showing an attaching state of a front pulley holder and packing member.

As shown in FIGS. 4 and 5, the rear side panel 15 is formed with a front cable hole 17 through which the wire cable 10 passes. A flexible packing member 18 made of rubber is attached to the cable hole 17 to close a gap between the cable 10 and the hole 17. The packing member 18 includes a large-diameter portion 35 having a diameter larger than that of the cable hole 17, an inserting portion 19 having a diameter approximately equal to that of the cable hole 17, and a flange 36 formed at the tip end of the inserting portion 19. As shown in FIG. 5, when the inserting portion 19 is inserted into the hole 17 by using a V-shaped cut out portion 37, the flange 36 engages elastically with the periphery of the hole 17, so that the packing member 18 is fixed temporarily to the hole 17.

As shown in FIG. 4, the front pulley holder 31 to which the front pulley 6 is mounted has a holder case 23 which is formed with a contact surface 38 abutting on the vehicle body 1 (outer side panel 15 or inner side panel 16) and a recess 39 receiving the large-diameter portion 35 of the packing member 18. The holder case 23 is formed of a metal or a synthetic resin having a sufficient strength. When the holder case 23 is fixed to the vehicle body 1 by means of fasteners 24 such as screws or bolts, the large-diameter portion 35 of the packing member 18 is strongly pressed against the side panel 15 (or the inner panel 16) by a bottom or pressing surface 40 of the recess 39, so that the packing member 18 is firmly and finally held between the panel 15 and the holder case 23. Thus, in the present invention, by fixing the holder case 23 to the vehicle body 1, the packing member 18 can be fixed finally, so that the installation work of the packing member 18 is simple and the installation strength increases significantly.

Preferably, an inner tube 21, which is formed of a relatively rigid resin, is installed in the packing member 18 to prevent the wear of the packing member 18 and to improve the waterproofness. The inner tube 21 is formed with a protrusion 22 engaging with the packing member 18. The inner tube 21 can also be installed in the packing member 18 by insert molding.

A rear cable hole 41 corresponding to the front cable hole 17 is formed in the side panel 15 in the vicinity of the rear end of the guide rail 3, and a rear flexible packing member 42 is installed in the rear cable hole 41. It is noted that, like the front packing member 18, the rear packing member 42 is also fixed firmly to the panel 15 by using the rear pulley holder 32.

The foregoing discussion discloses and describes merely exemplary embodiment of the present invention only. One skilled in the art will readily recognize from such discussion, and from the accompanying drawings and claims, that various changes, modifications and variations can be made therein without departing from the spirit and scope of the invention as defined in the following claims.

What is claimed is:

1. A packing mounting structure, comprising:

an elongated guide rail fixed to an outside surface of a side panel of a vehicle body;

a sliding door mounted on the vehicle body and slidable along the guide rail between an open position and a closed position;

a powered sliding unit arranged on an interior side of the side panel;

a wire cable provided between the sliding door and the powered sliding unit for pulling the sliding door toward the open position or the closed position by power of the powered sliding unit;

a first pulley holder provided in the vicinity of a first end of the guide rail and having a first pulley around which the cable wire is set;

a first cable hole formed on the side panel in the vicinity of the first end of the guide rail for passing the wire cable through the side panel;

a first flexible packing member mounted in the first cable hole to close a gap between the first cable hole and the wire cable;

said first pulley holder being fixed to the side panel by means of a screw or bolt; and said first packing member having a first inserting portion which is inserted into the first cable hole, and a first large-diameter portion which has a diameter sufficiently larger than that of the first cable hole and abuts on an inside surface of the side panel when the first inserting portion is inserted into the first cable hole;

wherein said first large-diameter portion is firmly sandwiched between the first pulley holder and the side panel.

2. A packing mounting structure according to claim 1, wherein said first pulley holder has a contact surface which abuts on the inside surface of the side panel and a pressing surface which comes into contact with the first large-diameter portion.

3. A packing mounting structure according to claim 1, wherein said first inserting portion has at its tip end a flange which is detachably engaged with the outside surface of the side panel.

4. A packing mounting structure according to claim 1, wherein said first packing member has an inner tube made of a rigid resin inside through which the wire cable passes.

5. A packing mounting structure according to claim 4, wherein said inner tube is formed with a protrusion engaging with the first packing member.

6. A packing mounting structure according to claim 4, wherein said inner tube is installed in the first packing member by insert molding.

7. A packing mounting structure according to claim 1, further comprising:

a second pulley holder provided in the vicinity of a second end of the guide rail and having a second pulley around which the cable wire is set;

a second cable hole formed on the side panel in the vicinity of the second end of the guide rail for passing the wire cable through the side panel;

a second flexible packing member mounted in the second cable hole to close a gap between the second cable hole and the wire cable;

said second pulley holder being fixed to the side panel by means of a screw or bolt; and said second packing member having a second inserting portion which is inserted into the second cable hole, and a second large-diameter portion which has a diameter sufficiently larger than that of the second cable hole and abuts on the inside surface of the side panel when the second inserting portion is inserted into the second cable hole;

wherein said second large-diameter portion is firmly sandwiched between the second pulley holder and the side panel.

* * * * *